United States Patent [19]

Itoh

[11] Patent Number: 4,504,058

[45] Date of Patent: Mar. 12, 1985

[54] SLOT MACHINE

[75] Inventor: Yoshie Itoh, Tokyo, Japan

[73] Assignee: Wagner Shokai, Inc., Tokyo, Japan

[21] Appl. No.: 461,457

[22] Filed: Jan. 27, 1983

[30] Foreign Application Priority Data

May 2, 1982 [JP] Japan ..... 57-016391

[51] Int. Cl.[3] ..... A63F 5/04

[52] U.S. Cl. ..... 273/143 R

[58] Field of Search ..... 273/143, 138

[56] References Cited

U.S. PATENT DOCUMENTS

| | | | |
|---|---|---|---|
| 2,152,599 | 3/1939 | Mills | 273/143 R |
| 2,579,241 | 12/1951 | Nicolaus | 273/143 R |
| 3,209,883 | 10/1965 | Hopps | 273/143 R UX |
| 4,261,571 | 4/1981 | Ito | 273/143 R |

FOREIGN PATENT DOCUMENTS

| | | | |
|---|---|---|---|
| 136877 | 4/1950 | Australia | 273/143 R |

*Primary Examiner*—Paul E. Shapiro

[57] ABSTRACT

A slot machine comprising a plurality of rotatable drums bearing pictures, symbols, etc. on their peripheries, a plurality of coin cases, a mechanism for rotating the drums, a mechanism for stopping the drums, and a mechanism for discharging coins. By a simple operation of pulling an actuating lever forward, the slot machine automatically rotates the drums for a period of time, automatically stops the drums in regular sequence and at intervals, and automatically discharges coins by opening one or some or all of the coin cases when one or more predetermined pictures, symbols, etc. or a predetermined combination thereof is obtained. Thus, the slot machine of the invention is easy to operate, and offers diversified and interesting games.

3 Claims, 27 Drawing Figures

SLOT MACHINE

BACKGROUND OF THE INVENTION

1. Field of the Invention

The present invention relates to a mechanical slot machine.

2. Description of the Prior Art

Drum-type slot machines designed to discharge coins according to the combinations of pictures, symbols, etc. shown on the peripheries of a plurality of rotatable drums have been widely known. Many of them have been electrically driven slot machines using an electric motor to rotate the drums and electromagnetic brakes to stop them. Because these electrically driven slot machines need not only the electric motor and electromagnetic brakes but also a battery or other power source therefor, they have had large and complicated mechanisms and have been expensive.

In view of these points, the inventor has already invented mechanical slot machines, as found in Japanese patent application No. Sho 53-154,910 (U.S. Pat. No. 4,261,571) and No. Sho 55-48,097, which comprise a plurality of rotatable drums bearing pictures, symbols, etc. on their peripheries and a single coin case and which, by a simple operation of pulling an actuating lever forward, automatically rotate the drums for a period of time, automatically stop the drums in regular sequence and at intervals, and automatically discharge coins only when a predetermined combination of pictures, symbols, etc. on all the drums is obtained. However, these mechanical slot machines have had the disadvantage that the game is relatively simple and not very exciting, because they have only one coin case and are designed to discharge coins only when a predetermined combination of pictures, symbols, etc. on all the drums is obtained.

BRIEF SUMMARY OF THE INVENTION

It is an object of the present invention to provide an improved slot machine which has obviated all the above-mentioned disadvantages of the slot machines of the prior art.

Such and other objects have been attained by a slot machine which comprises a plurality of rotatable drums bearing pictures, symbols, etc. on their peripheries and a plurality of coin cases and which, by a simple operation of pulling an actuating lever forward, automatically rotates the drums for a period of time, automatically stops the drums in regular sequence and at intervals by means of a stopper mechanism, and automatically discharges coins by opening one or some or all of said coin cases when one or more predetermined pictures, symbols, etc. or a predetermined combination thereof is obtained.

BRIEF DESCRIPTION OF THE DRAWINGS

FIG. 1 is a perspective view illustrating the appearance of said slot machine.

FIG. 2 is a perspective view of said slot machine, a front frame being removed therefrom.

FIG. 3 is a front view illustrating the interior construction of said slot machine.

FIG. 4 is a rear view illustrating the interior construction of said slot machine.

FIGS. 5 and 6 are side views illustrating the relation between a kicker and a rotatable drum, etc.

FIG. 7 is an exploded view in perspective illustrating the construction of an actuating lever, kicker, etc.

FIG. 8 is a perspective view, partially omitted, illustrating the relation between a movable frame and a cam plate, etc.

FIGS. 9 to 11 are plan views illustrating the relation between movable frames and the cam plate.

FIG. 14 is a side view illustrating the relation between the cam plate and a control cam.

FIG. 15 is a side view illustrating a mechanical timer.

FIG. 16 is a side view illustrating the relation between a driving gear in the mechanical timer and a driven gear in a mechanism for ringing a bell.

FIG. 17 is a side view illustrating said mechanism for ringing a bell.

FIG. 18 is a side view illustrating a restraining lever, etc. in said mechanism.

FIG. 19 is a side view illustrating a mechanism for turning a lamp on and off.

FIG. 20 is a perspective view illustrating a mechanism for discharging coins.

FIGS. 21 and 22 are partially sectional side views illustrating the operation thereof.

DETAILED DESCRIPTION

Figure 1:
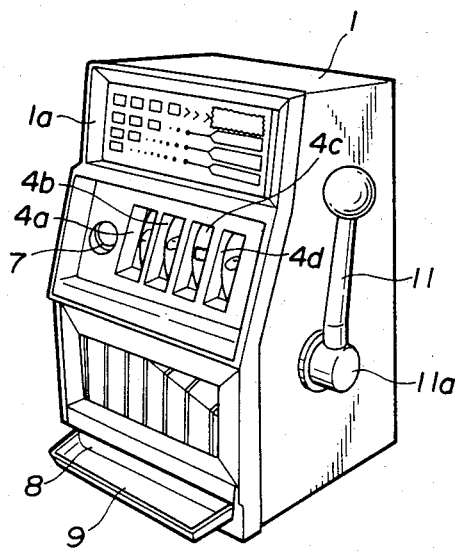
FIGS. 1 to 22 illustrate a slot machine according to an embodiment of the invention.

The present invention will now be described in detail with reference to embodiments illustrated in the drawings.

Figure 2:
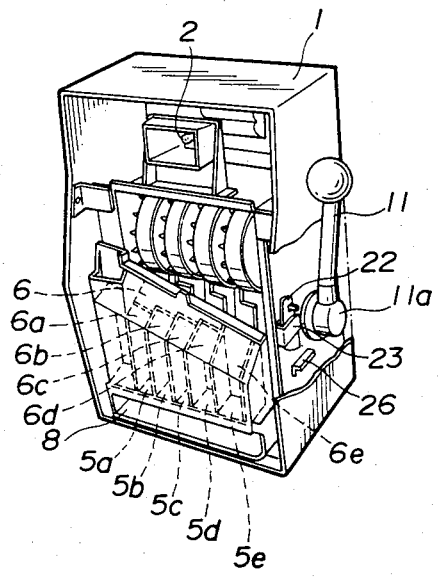

FIGS. 1 to 22 illustrate an embodiment of the present invention. In FIGS. 1, 2, etc., numeral 1 represents a casing of a slot machine. The casing 1 is provided at its front with a front frame (decorative frame) 1*a* which is divided into three portions as follows: an upper portion for explaining the game, etc., a central portion having windows through which rotatable drums contained in the casing 1 are visible, and a lower portion for discharging coins. At the back of the upper portion, there is a lamp 2 which is turned on and off for instance when a predetermined combination of pictures, symbols, etc. on the rotatable drums appears in the windows. The number of the windows corresponds to that of the rotatable drums, and in this embodiment there are four rotatable drums 3*a* to 3*d* and four windows 4*a* to 4*d*. At the back of the lower portion of the front frame 1*a*, there are five, for instance, coin cases 5*a* to 5*e* each having a rectangular cross section. The lower portion of each coin case is usually closed by a coin shutter which will be described later. The coin cases 5*a* to 5*e* contain different kinds of coins. For instance, the first coin case 5*a* contains 10-cent coins, the second coin case 5*b* contains 1-cent coins, the third coin case 5*c* contains 5-cent coins, the fourth coin case 5*d* contains 25-cent coins, and the fifth coin case 5*e* contains 50-cent coins. The front plate of the coin cases 5*a* to 5*e* is transparent. On top of the coin cases 5*a* to 5*e*, there is a sorting plate 6 which is inclined downward toward the right in FIG. 2 and is provided above the respective coin cases 5*a* to 5*e* with sorting holes 6*a* to 6*e* corresponding to coin sizes. Numeral 7 represents a coin slot. Coins put into the coin slot 7 move on the sorting plate 6 and, according to their kinds, enter the coin cases 5*a* to 5*e* through the sorting holes 6*a* to 6*b*. Under the coin cases 5*a* to 5*e*, there are a common coin outlet 8 and a tray 9 adjacent thereto. The casing 1 is provided on its one side with an actuating lever 11 by means of which the mechanisms of the slot machine are put in motion. The lower end of the actuating lever 11 is fastened to a boss 11*a* which is secured to one end of a supporting shaft that projects out through the side wall of the casing 1 and serves to drive the mechanisms which will be described later.

Figure 3:
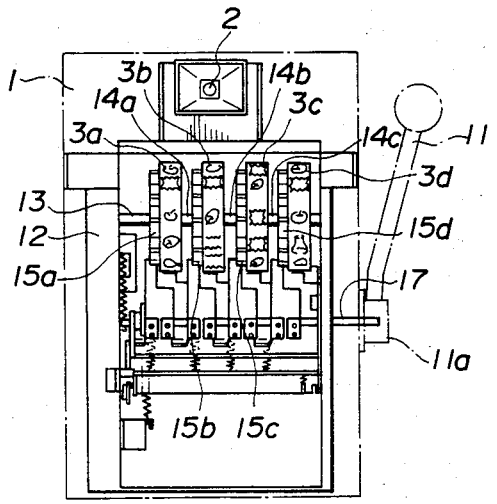
Figure 4:
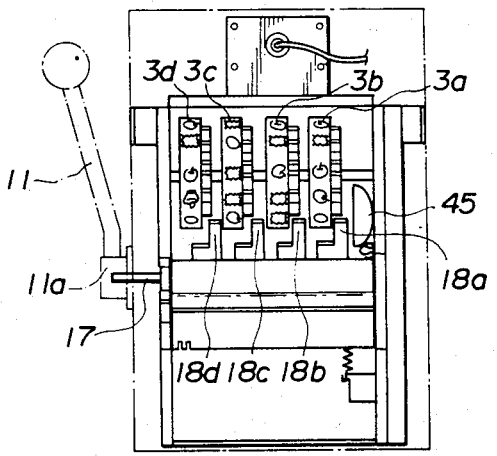

A frame 12 is disposed within the casing 1 as shown in FIGS. 3 and 4, and contains said rotatable drums 3*a* to 3*d* and mechanisms for driving them, stopping them and discharging coins.

Figure 5:
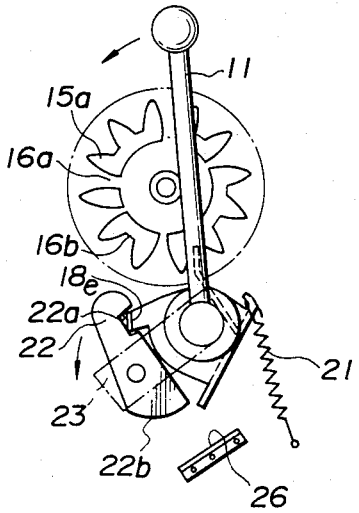
Figure 6:
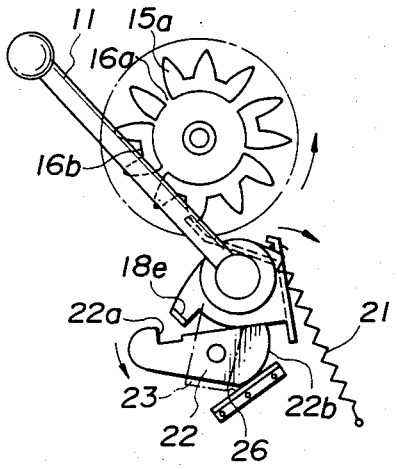

The rotatable drums 3*a* to 3*d* will now be described in detail. The four rotatable drums 3*a* to 3*d* in this embodiment are rotatably mounted on a drum shaft 13 which is horizontally disposed in the upper portion of the frame 12. The rotatable drums 3*a* to 3*d* are disposed at suitable intervals so that portions of their peripheries are visible through the windows 4*a* to 4*d*. In this embodiment, each rotatable drum has a hub protruding toward an adjacent rotatable drum, and between the rotatable drums 3*a* to 3*d* cylindrical spacers 14*a* to 14*c* are mounted on the drum shaft 13. Each of the rotatable drums 3*a* to 3*d* is provided on its periphery with several kinds of suitably spaced pictures, symbols, etc. representing a lemon, cherry, bell or the like. Each of said rotatable drums 3*a* to 3*d* is integrally provided on its one side with a notched disc 15*a*, 15*b*, 15*c* or 15*d* having notches 16*a* and 16*b* in positions corresponding to the pictures, symbols, etc. As shown in FIGS. 5, 6, etc., the notches 16*a* corresponding to some of the pictures, symbols, etc., which correspond to "hits" described later, are deeper than the notches 16*b* corresponding to the other pictures, symbols, etc.

Figure 7:
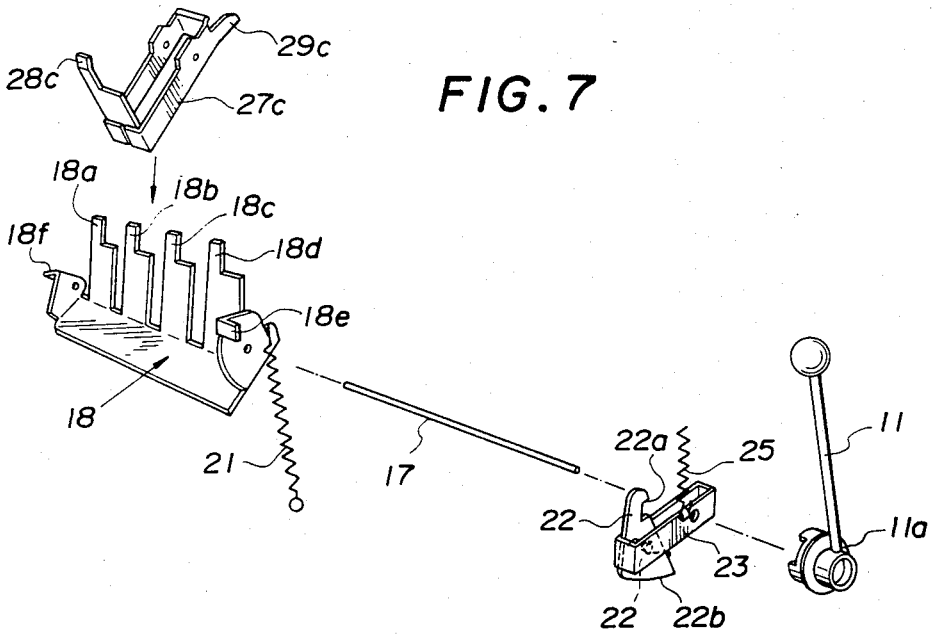
Figure 8:
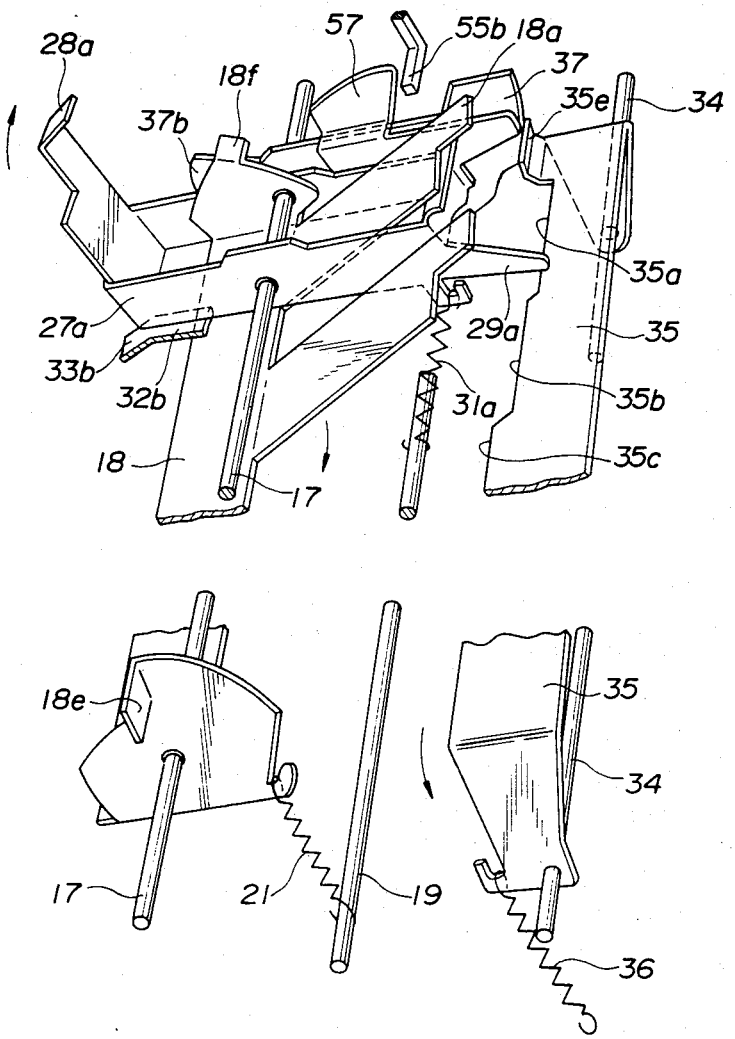

The mechanism for driving (starting) said rotatable drums 3*a* to 3*d* will now be described. As shown in FIGS. 3, 7, 8, etc., said supporting shaft 17 is horizontally disposed below said drum shaft 13 and at a suitable distance therefrom, and a kicker 18 for rotating all the rotatable drums 3*a* to 3*d* at the same time is rotatably attached to the supporting shaft 17. The kicker 18 has projections 18*a* to 18*d* disposed so that they can kick the notched discs 15*a* to 15*d* respectively from behind the rotatable drums 3*a* to 3*d* (see FIGS. 4 and 7). A spring supporting rod 19 is horizontally disposed below the supporting shaft 17, and the kicker 18 is always pulled in the direction of disengaging from the notched discs 15*a* to 15*d* by a spring 21 set between one end of the kicker 18 and the spring supporting rod 19. The kicker 18 is provided at its one end with a click 18*e* which protrudes, through a suitable opening (not shown) in the frame 12, toward said actuating lever 11.

An end of the supporting shaft 17 on the actuating lever side protrudes from the frame 12 through its side plate, and to this end of the shaft the actuating lever 11 is fastened through the boss 11*a* as mentioned above. A hook 22 and a supporting frame 23 are disposed between the boss 11*a* and the side plate of the frame 12. The supporting frame 23 is fastened to the boss 11*a* by means of screws. The hook 22 is pivotally attached to the supporting frame 23 so as to turn on the pivot within certain limits. The hook 22 is provided in its upper portion with a notch 22*a* which engages with and disengages from the click 18*e* of the kicker 18 as the hook 22 turns on the pivot. The lower end of the hook 22 takes the shape of a circular arc and serves as its cam portion 22*b*. A wire spring 24 is provided between the hook 22 and the supporting frame 23. Another spring 25 is set between the supporting frame 23 and the frame 12 in such a way that it always pulls the whole supporting frame 23 clockwise, that is, in the same direction as the kicker 18 is pulled by its spring 21. (In this Specification, the clockwise or counterclockwise direction shows the direction of rotation or turn when seen from the right side of the slot machine). By the force of the wire spring 24 and the spring 25, the hook 22 is usually given a tendency to turn in the direction of engaging its notch 22*a* with the click 18*e* of the kicker 18. The frame 12 is provided on its side plate with an inclined plane 26 corresponding to the cam portion 22*b* of the hook 22, as shown in FIGS. 5 and 6. When the supporting frame 23 is turned counterclockwise to a certain degree by means of the actuating lever 11, the cam portion 22*b* of the hook 22 contacts the inclined plane 26 and the hook 22 turns against the force of the wire spring 24 so as to disengage from the click 18*e* of the kicker 18.

Figure 9:
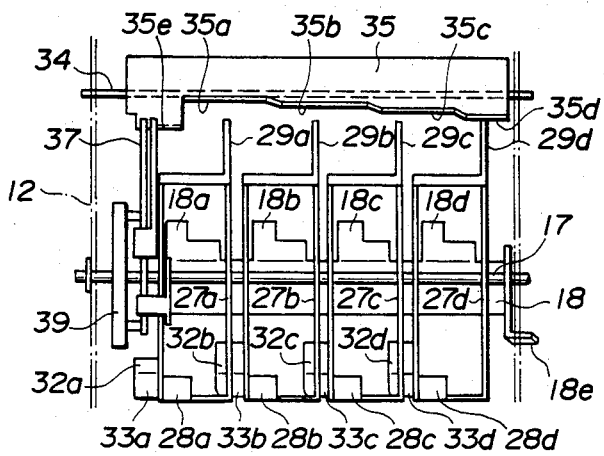
Figure 10:
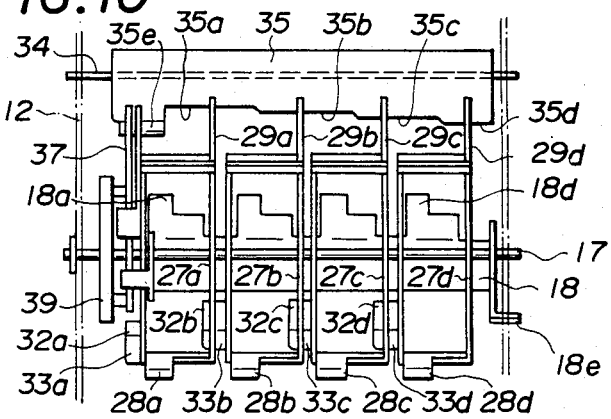
Figure 11:
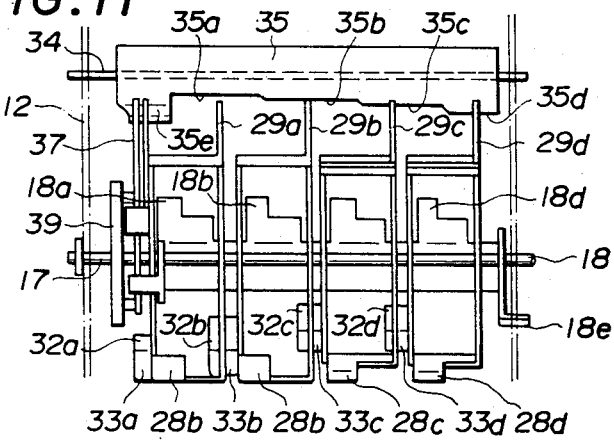
Figure 12A:
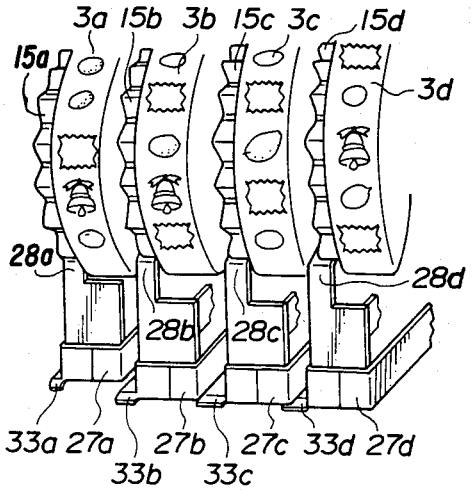
FIGS. 12(A) and (B) are perspective views illustrating the relation between the movable frames and notched discs.
Figure 12B:
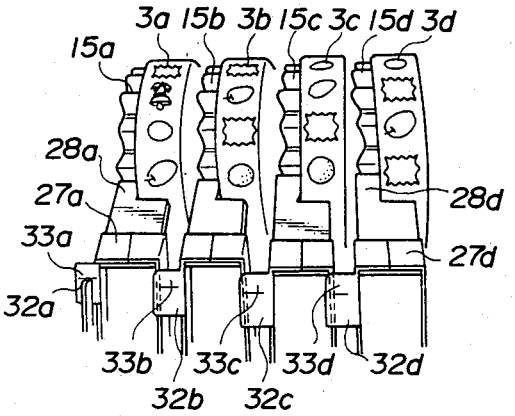
Figure 13A:
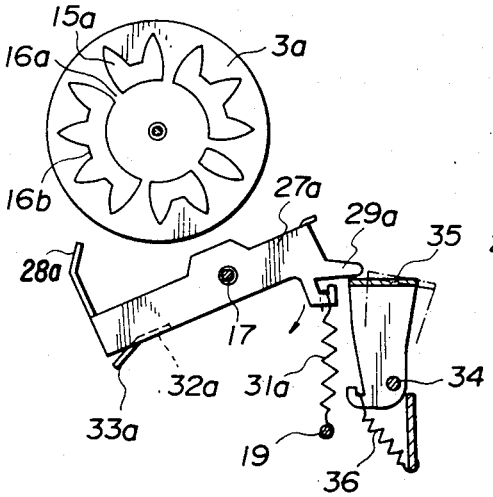
FIGS. 13(A) and (B) are side views illustrating the operation of a movable frame, etc. in relation to a notched disc.
Figure 13B:
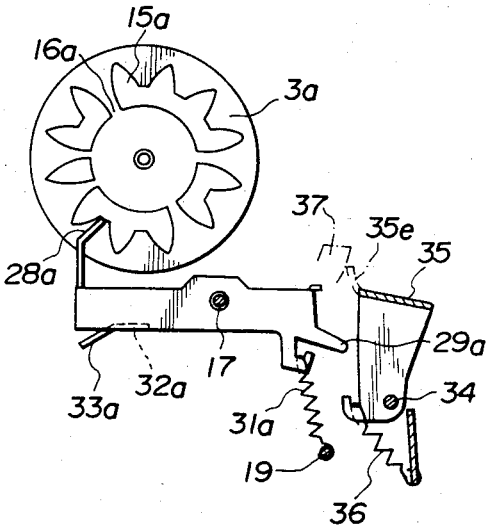
Figure 14:
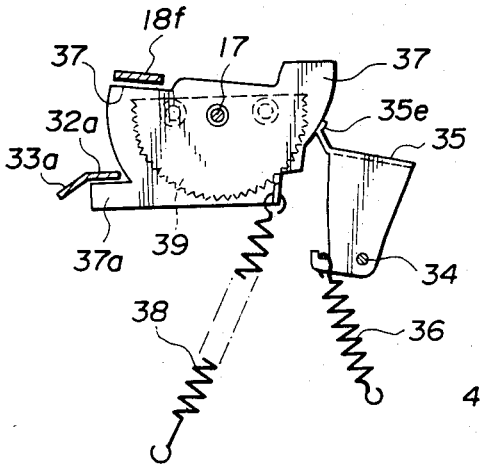

Reference will now be made to the mechanism for stopping said rotatable drums 3*a* to 3*d* including a mechanical timer. As shown in FIGS. 8 to 13, four movable frames 27*a* to 27*d* corresponding to the four rotatable drums 3*a* to 3*d* are rotatably mounted on the supporting shaft 17 in such a way that the movable frames 27*a* to 27*d* respectively surround the projections 18*a* to 18*d* of the kicker 18. The movable frames 27*a* to 27*d* are respectively provided at their front end (their lower portion in FIGS. 9 to 11) with stoppers 28*a* to 28*d* projecting upward therefrom so as to be engageable with said notched discs 15*a* to 15*d*, and at their rear end with engaging portions 29*a* to 29*d* projecting rearward therefrom so as to be engageable with a cam plate which is to be described later (See FIG. 8). Springs 31*a* to 31*d* are respectively set between the rear end of the movable frames 27*a* to 27*d* and the spring supporting rod 19 so as to respectively give the movable frames 27*a* to 27*d* a tendency to turn in the direction of engaging their stoppers 28*a* to 28*d* with the notched discs 15*a* to 15*d* (see FIGS. 13A and 13B). Each of the movable frames 27*b* to 27*d* is provided in its frontal lower portion with a bent connecting means 32*b*, 32*c* or 32*d* which connects the movable frame with an adjacent movable frame. The connecting means 32*b* to 32*d* are arranged in the same direction. The connecting means 32*b* protrudes from the second movable frame 27*b* toward the first movable frame 27*a*. The connecting means 32*c* protrudes from the third movable frame 27*c* toward the second movable frame 27*b*. The connecting means 32*d* protrudes from the fourth movable frame 27*d* toward the third movable frame 27*c*. When the first movable frame 27*a* is turned against the force of the spring 31*a*, the other three movable frames 27*b* to 27*d* are turned together with the first movable frame 27*a* through the connecting means 32*b* to 32*d*. Unless the stopper 28*a* of the first movable frame 27*a* enters one of the deep notches 16*a* of the notched disc 15*a* (The entering of the stopper of a movable frame into one of the deep notches 16*a* of a notched disc will hereinafter be referred to as "hit"), the stoppers 28*b* to 28*d* of the other movable frames 27*b* to 27*d* do not hit. FIG. 12A is a perspective view showing a state where the first movable frame 28*a* hits and the second to fourth movable frames 28*b* to 28*d* do not hit. FIG. 12B is a perspective view, taken from below, showing a state where no movable frame hits. A bent member 32*a* attached to the first movable frame 27*a* serves as a means for restraining a control cam from turning. (The control cam is to be described later.) As shown in FIG. 13A, the restraining means 32*a* and the connecting means 32*b* to 32*d* are integrally provided with driving means 33*a* to 33*d*, each resembling a tongue in shape, for driving coin shutters described later. A cam shaft 34 is horizontally disposed in the rear portion of the frame 12, and on this cam shaft 34 said cam plate 35 is rotatably mounted. One edge of the cam plate 35 is stepped so as to form cam edges 35*a* to 35*d* corresponding to said engaging portions 29*a* to 29*d* of the movable frames 27*a* to 27*d*, said cam edges 35*a* to 35*d* being adapted to engage with and disengage from the engaging portions 29*a* to 29*d* as follows: When the cam plate 35 is turned in the direction of disengagement after all the cam edges 35*a* to 35*d* are engaged with the corresponding engaging portions 29*a* to 29*d*, the engagement between the cam edge 35*a* and the engaging portion 29*a* on the leftmost side in FIG. 9 is released first, and then the engagements between the other cam edges 35*b* to 35*d* and the other engaging portions 29*b* to 29*d* are released in regular sequence and at intervals according to the angle of the cam plate 35. FIG. 9 shows a state where all the engaging portions 29*a* to 29*d* have been disengaged from the cam plates 35*a* to 35*d* and the movable frames 27*a* to 27*d* have returned to their original positions as shown in FIG. 13B. FIG. 10 shows a state where all the engaging portions 29*a* to 29*d* have been engaged with the cam plates 35*a* to 35*d* and the movable frames 27*a* to 27*d* are urged as shown in FIG. 13A. FIG. 11 shows a state where the first and second engaging portions 29*a* and 29*b* have been disengaged from the cam plates 35*a* and 35*b* and the first and second movable frames 27*a* and 27*b* have returned to their original positions. A spring 36 is set between the cam plate 35 and the frame 12 so as to pull the cam plate 35 in the direction of engaging its cam edges 35*a* to 35*d* with the engaging portions 29*a* to 29*d*. The cam plate 35 is provided at its one end with a bent control portion 35*e* which is usually in contact with said control cam 37 so as to keep the cam plate 35 out of engagement with the engaging portions 29*a* to 29*d* against the force of said spring 36. As shown in FIG. 14, the control cam 37, rotatably mounted on the supporting shaft 17, has an approximately sectorial shape, and a spring 38 is set between one end of its lower portion and the frame 12 so as to pull the control cam 37 clockwise. The control cam 37 is provided at the other end of its lower portion with a projection 37*a* which is usually engaged with said restraining means 32*a* of the movable frame 27*a* so that the control cam 37 is usually restrained from turning. The upper corner 37*b*, on the same side as said projection 37*a*, of the control cam 37 is engageable with a click 18*f* protruding from one side of said kicker 18.

Figure 15:
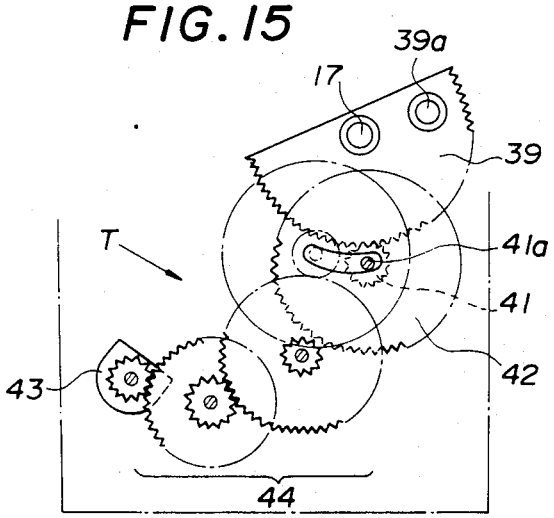

Reference will now be made to the mechanical timer (see FIG. 15) for slowly returning said cam plate 35 in the direction of releasing its engagement with the engaging portions 29*a* to 29*d* of the movable frames 27*a* to 27*d*. The mechanical timer T is disposed near the end of the supporting shaft 17 on the side opposite to said actuating lever 11. A driving gear 39 having a semicircular shape is secured to one side of the control cam 37 as shown in FIG. 14. Under the driving gear 39, a pinion 41 is disposed, which is always in meshing contact with the driving gear 39 as shown in FIG. 15. The pinion 41 is attached through a pinion shaft 41*a* to the side plate of the frame 12 so as to be swingable backward and forward within certain limits, and a first transmission gear 42 is fastened to the pinion shaft 41*a*. The transmission gear 42 is disengageably engaged with one of speedup gears 44 having a flywheel 43 attached to a final pinion. The pinion 41 is swung backward and forward by the turning of the driving gear 39. When the driving gear 39 is turned counterclockwise by pulling the actuating lever 11 forward, the pinion 41 is disengaged from the speedup gears 44. Thereafter, when the driving gear 39 starts to turn clockwise by the force of the spring 38, the pinion 41 is moved and engaged with the speedup gears 44.

Figure 16:
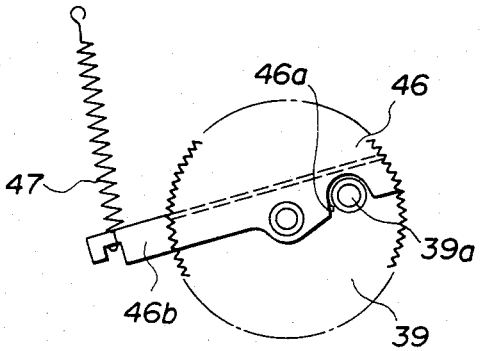
Figure 17:
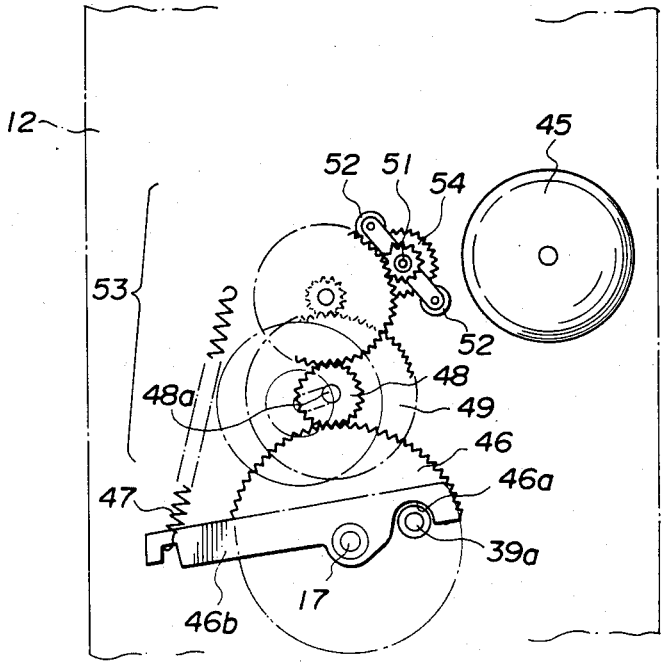
Figure 18:
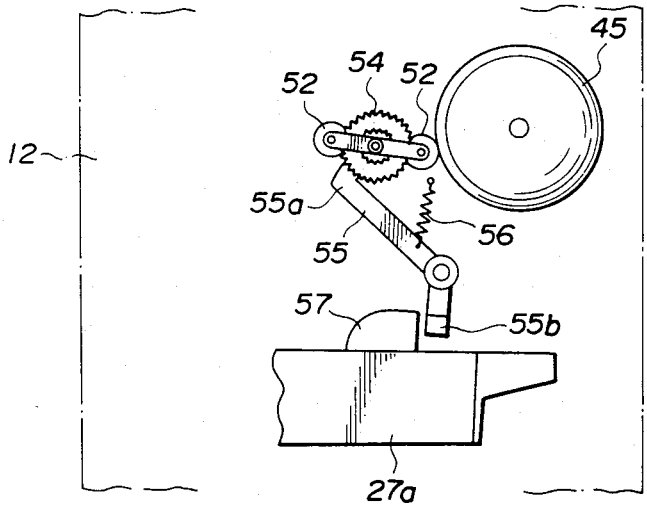

A mechanism for ringing a bell 45 when said first movable frame 27*a* has hit will now be described with reference to FIGS. 16 to 18. A driven gear 46 having a reversed semicircular shape is rotatably mounted on the supporting shaft 17 so as to be close to the semicircular driving gear 39 in said mechanical timer T. The driving gear 39 is provided with a pin 39*a*, and the driven gear 46 is provided with a notch 46*a* corresponding to the pin 39*a*. Only when the driving gear 39 is turned counterclockwise by means of the actuating lever 11, the driven gear 46 is connected with the driving gear 39 through the pin 39*a* and the notch 46*a*, and is turned in the same direction as the driving gear 39. A long plate 46*b* is fixed to the driven gear 46, and a spring 47 is set between one end of the long plate 46*b* and the frame 12. The spring 47 always gives the driven gear 46 a tendency to turn clockwise, but this tendency is usually controlled by a restraining lever which is to be described later. Over the driven gear 46, a pinion 48 is disposed, which is always in meshing contact with the driven gear 46. The pinion 48 is attached through a pinion shaft 48*a* to the side plate of the frame 12 so as to be swingable backward and forward within certain limits, and a first transmission gear 49 is fastened to the pinion shaft 48*a*. The first transmission gear 49 is disengageably engaged with one of speedup gears 53 having two rotatable ringing rollers 52 attached to the shaft 51 of a final pinion. A restraining gear 54 is also mounted on the pinion shaft 51, and said restraining lever 55 corresponding thereto is swingably attached to the side plate of the frame 12. A spring 56 is set between the restraining lever 55 and the frame 12 so that the working end 55*a* of the restraining lever 55 is usually engaged with the restraining gear 54 to restrain the operation of the ringing mechanism. The other end 55*b* of the restraining lever 55 faces a pushing means 57 secured to the first movable frame 27*a* as shown in FIG. 8.

Figure 19:
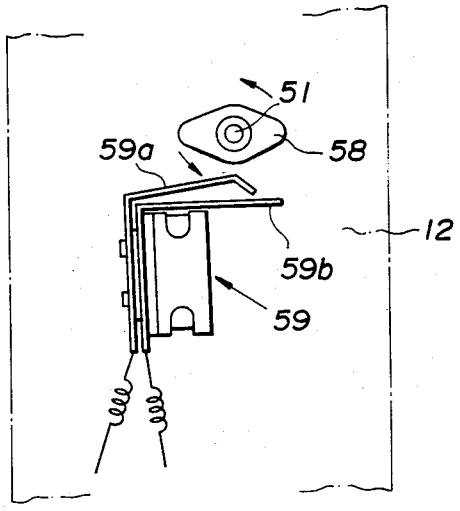

A mechanism for turning on and off said lamp 2 will now be described with reference to FIG. 19. One end of said pinion shaft 15 protrudes out of the side plate of the frame 12, and to this end a switch actuator 58 having an approximately rhombic shape is fixed. A switch 59 comprising a movable electrode 59*a* and a fixed electrode 59*b* is disposed under the switch actuator 58, said movable electrode 59*a* facing the switch actuator 58. The switch 59 is contained in the electric power circuit (not shown) of the lamp 2.

Figure 20:
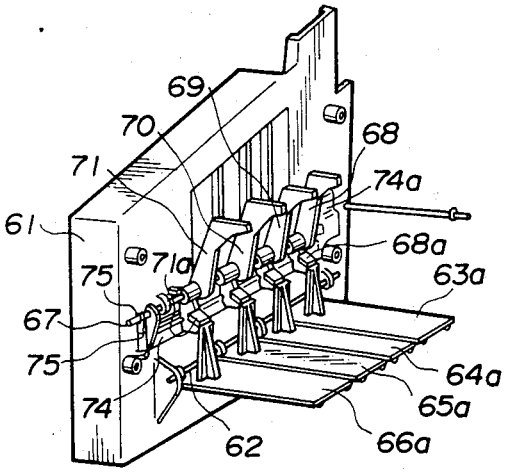
Figure 21:
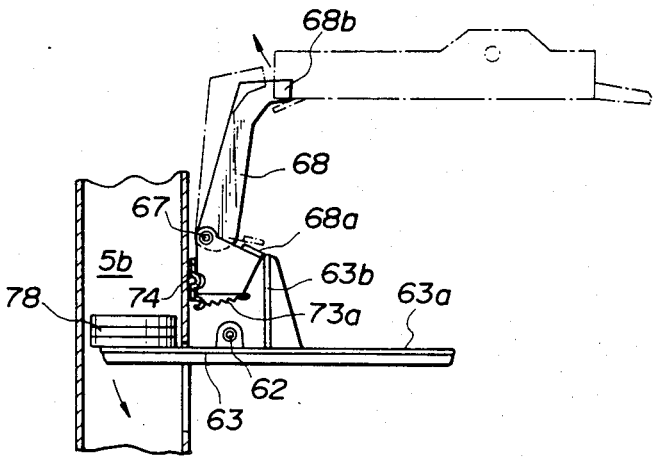
Figure 22:
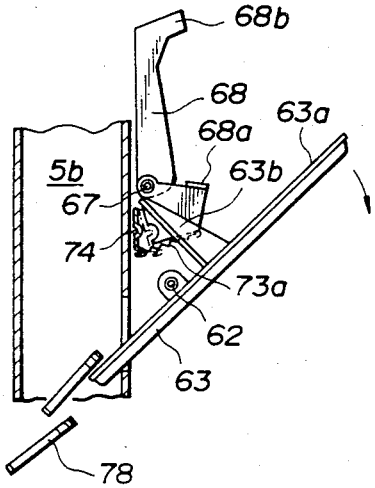

Next, the mechanism for discharging coins will be described with reference to FIGS. 20 to 22. Numeral 61 in FIG. 20 represents a supporting frame of said coin cases 5*a* to 5*e*. A shaft 62 is horizontally disposed at the back of the supporting frame 61 and near the lower portions of the coin cases 5*a* to 5*e*. In this embodiment, four coin shutters 63 to 66 for the five coin cases 5*a* to 5e are rotatably mounted on the shaft 62. The coin shutter 63 is wider than the other coin shutters 64 to 66, and serves as a common shutter for both the first coin case 5a and the second coin case 5b. Altermatively, the number of the coin cases may be the same as that of the rotatable drums, and a coin shutter may be used for each of the coin cases. The coin shutters 63 to 66 are integrally provided with rear plate portions 63a to 66a extending rearward therefrom, and are provided behind the shaft 62 with erect portions 63b to 66b. The rear plate portions 63a to 66a serve as weights for returning the coin shutters 63 to 66 to closed positions after coins have been discharged. Another shaft 67 is horizontally disposed above said shaft 62, and coin stoppers 68 to 71 corresponding to the coin shutters 63 to 66 are rotatably mounted on the shaft 67. The coin stoppers 68 to 71 are provided with latches 68a to 71a corresponding to the erect portions 63b to 66b of coin shutters 63 to 66. The upper portions of the coin stoppers 68 to 71 are hook-shaped so as to form engaging portions 68b to 71b which are engageable with said driving means 33a to 33d of the movable frames 27a to 27d. Springs 73a to 73d are set respectively between the lower portion of the coin stoppers 68 to 71 and the frame 12 so that the coin stoppers 68 to 71 usually latch the coin shutters 63 to 66. Between the coin stoppers 68 to 71 and the rear surface of the supporting frame 61, a single release plate 74, common to all the coin stoppers 68 to 71, is rotatably mounted on the shaft 67. The release plate 74 is provided at its one end with a driving portion 74a, and a wire spring 75 is disposed between the other end of the release plate 74 and the supporting frame 61. A release 76, which can be pushed from behind the frame 12, is disposed so that its end faces the driving portion 74a of the release plate 74. When the release 76 is pushed inward, the release plate 74 is turned against the force of the wire spring 75 so as to turn all the coin stoppers 68 to 71 in the direction of disengaging from the coin shutters 63 to 66.

The operation of the slot machine of this invention will now be described. Before the starting of the game, a certain number of different kinds of coins 78 are put into the coin slot 7. These coins 78 are sorted by the sorting holes 6a to 6e, and 10-cent coins enter the first coin case 5a, 1-cent coins entering the second coin case 5b, 5-cent coins entering the third coin case 5c, 25-cent coins entering the fourth coin case 5d, 50-cent coins entering the fifth coin case 5e. The front plate of the coin cases 5a to 5e is transparent, and the coins in the coin cases are visible through the front plate. When the actuating lever 11 is pulled forward, the supporting frame 23 rigidly secured through the boss 11a to the actuating lever 11 and the hook 22 pivotally attached to the supporting frame 23 are turned counterclockwise. Because the hook 22 is engaged with the click 18e of the kicker 18, the kicker 18 is turned counterclockwse against the force of the spring 21 as the hook 22 is turned. When the kicker 18 is turned in this way, the control cam 37 and then the first movable frame 27a are turned counterclockwise against the force of the spring 38 and 31a by another click 18f of the kicker 18. Then, the other three movable frames 27b to 27d are turned together with the first movable frame 27a through the connecting means 32b to 32d. Therefore, the stoppers 28a to 28d of the movable frames 27a to 27d are disengaged from the notched discs 15a to 15d, and now the rotatable drums 3a to 3d are ready to rotate freely. On the other hand, when the control cam 37 is turned counterclockwise, the cam plate 35 is turned counterclockwise by the force of the spring 36, the control portion 35e of the cam plate 35 being guided by the control cam 37. When the actuating lever 11 is pulled forward further, the projections 18a to 18d of the kicker 18 are engaged with the notched discs 15a to 15d (FIG. 5), and the engaging portions 29a to 29d of the movable frames 27a to 27d move upward to a certain degree. Then, the cam plate 35 comes under the engaging portions 29a to 29d and the cam edges 35a to 35d thereof are respectively engaged with the engaging portions 29a to 29d (FIGS. 10 and 13(A)). When the actuating lever 11 is pulled forward still further, the cam portion 22b at the lower end of the hook 22 comes into contact with the inclined plane 26, and the hook 22 is turned on the inclined plane 26 counterclockwise in relation to the supporting frame 23 so as to be disengaged from the click 18e of the kicker 18 (FIG. 6). As a result, the kicker 18 is quickly returned clockwise by the accumulated force of the spring 21. At that time, the kicker 18 rotates all the rotatable drums 3a to 3d counterclockwise simultaneously by kicking their notched discs 15a to 15d with its projections 18a to 18d.

When the kicker 18 has returned to its original position by the action of the spring 21, the control cam 37, which has been turned by the click 18f of the kicker 18, is returned to its original position (FIG. 14) by the force of the spring 38. At this time, the control cam 37 turns slowly because it is connected through the driving gear 39 with the mechanical timer T. In connection therewith, the operation of the mechanical timer T will now be described in detail. When the control cam 37 is turned counterclockwise as mentioned above by pulling the actuating lever 11 forward, only the control cam 37 and the driving gear 39 secured to one side thereof are turned against the force of the spring 38 and their rotation is not transmitted to the speedup gears 44, because the pinion 41 is disengaged from the speedup gears 44. When the kicker 18 has returned to its original position and the control cam 37 and the driving gear 39 start to turn clockwise by the action of the spring 38, the driving gear 39 is engaged with the speedup gears 44 through the intermediary of the pinion 41 and therefore the returning speed of the control cam 37 and the driving gear 39 is slowed down by the speedup gears 44.

When the control cam 37 slowly returns clockwise, the cam plate 35 is pushed and turned clockwise thereby through its control portion 35e. When the cam plate 35 has turned to a certain degree, the engaging portion 29a of the first movable frame 27a is disengaged from the cam edge 35a of the cam plate 35. As a result, the first movable frame 27a is quickly returned by the force of the spring 31a and its stopper 28a engages with the notched disc 15a of the rotatable drum 3a (FIG. 13(B)). When the cam plate 35 is turned further, the engaging portions 29b to 29d of the movable frames 27b to 27d are disengaged from the corresponding cam edges 35b to 35d of the cam plate 35 in regular sequence and at intervals. Thus, the movable frames 27b to 27d are quickly returned by the force of the springs 31b to 31d and their stoppers 28b to 28d respectively engage with the notched discs 15b to 15d of the rotatable drums 3b to 3d. FIG. 11 shows a state where the engaging portions 29a and 29b of the movable frames 27a and 27b have been disengaged from the cam edges 35a and 35b of the cam plate 35, and the movable frames 27a and 27b have returned to their original positions. As mentioned with respect to FIGS. 12A and 12B, when the stoppers 28a to 28*d* of the movable frames 27*a* to 27*d* engage with the notched discs 15*a* to 15*d* of the rotatable drums 3*a* to 3*d*, each of the stoppers 28*a* to 28*d* enters one of either the deep notches 16*a* or the shallow notches 16*b* of each notched disc. Unless the stopper 28*a* of the first movable frame 27*a* hits, the stopper 28*b* of the second movable frame 27*b* does not hit because the second movable frame 27*b* is connected with the first movable frame 27*a* by the connecting means 32*b*. Unless the second movable frame 27*b* hits, the third movable frame 27*c* does not hit. Unless the third movable frame 27*c* hits, the fourth movable frame 27*d* does not hit. That is, a movable frame (rotatable drum) having a low priority order does not hit unless all movable frames (rotatable drums) having a higher priority order hit. Thus, the game is diversified.

When the first movable frame 27*a* hits, the driving means 33*a* drives the coin stopper 68 counterclockwise and the latch 68*a* of the coin stopper 68 is disengaged from the erect portion 63*b* of the coin shutter 63. Then, the coin shutter 63, serving as the bottom of the two coin cases 5*a* and 5*b*, is turned counterclockwise by the weight of coins 78 thereon, and the coins 78 (10-cent coins and 1-cent coins) drop onto the tray 9. See FIGS. 21 and 22. When the other movable frames hit, the other coin cases discharge coins onto the tray 9 in the same way as mentioned above. If all the movable frames 27*a* to 27*d* hit, all the coin cases 5*a* to 5*e* discharge all coins. This is a big hit.

When the first movable frame 27*a* hits, the pushing means 57 pushes the restraining lever 55 counterclockwise so as to disengage it from the restraining gear 54. As a result, the driven gear 46 is turned clockwise by the force of the spring 47 and its turn is transmitted through the pinion 48 to the speedup gears 53. Now the pinion shaft 51 at the end of the speedup gears 53 is rotated at a high speed, and the rotatable ringing rollers 52 attached thereto ring the bell 45. See FIGS. 17 and 18.

At the same time that the bell 45 rings, the switch actuator 58 actuates the switch 59 so as to turn the lamp 2 on and off.

Thus, the slot machine of the present invention makes a hit with priority to preceding rotatable drums, discharges coins, rings the bell, and turns the lamp on and off. If coins remain in any of the coin cases 5*a* to 5*e* after the end of the game, for instance, the release 76 is pushed. Then, the release plate 74 turns all the coin stoppers 68 to 71 so as to open all the coin cases 5*a* to 5*e* at the same time.

Figure 23:
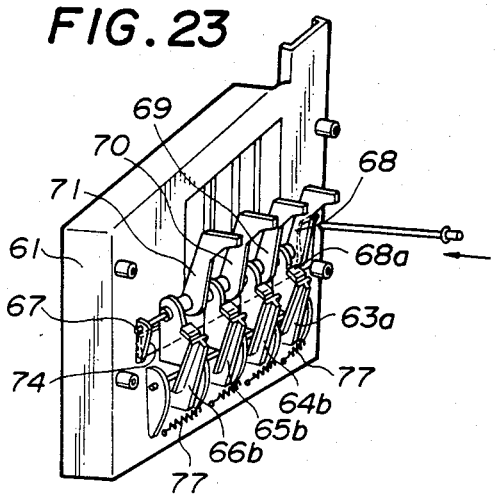
FIG. 23 is a perspective view illustrating a modified example thereof.
Figure 24:
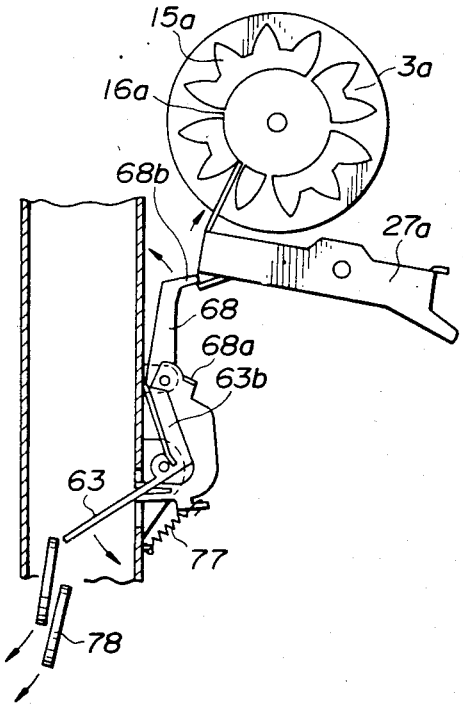
FIGS. 24 and 25 are partially sectional side views illustrating the operation of the modified example.
Figure 25:
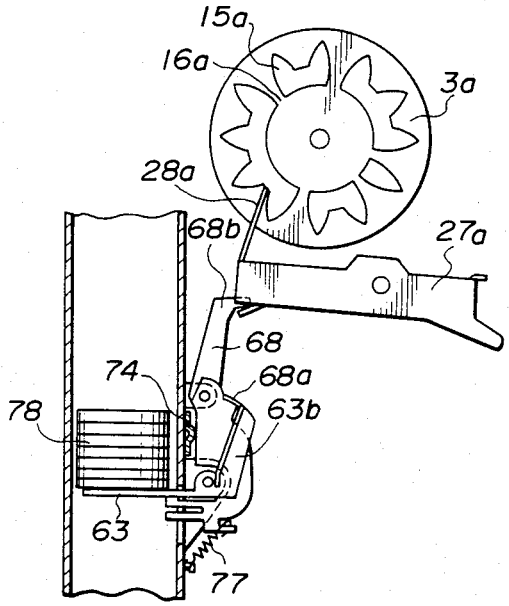

FIGS. 23 to 25 show a modified example of the mechanism for discharging coins. In this example, springs 77 are used instead of the rear plate portions 63*a* to 66*a* in FIGS. 20 to 22 as means for returning the coin shutters 63 to 66 to closed positions after coins have been discharged. This modified example is the same in operation as the example shown in FIGS. 20 to 22, but is advantageous in terms of space because the coin shutters 63 to 66 do not have the long rear plate portions 63*a* to 66*a*.

Thus, the slot machine of the present invention comprises a plurality of rotatable drums and a plurality of coin cases, said rotatable drums being rotated by pulling the actuating lever forward, said rotatable drums being stopped in regular sequence and at intervals by the stopper mechanism comprising the movable frames, etc., one or some or all of said coin cases discharging coins when one or more predetermined pictures, symbols, etc. or a predetermined combination thereof is obtained. Therefore, the game is diversified and interesting. Furthermore, the slot machine is easy to operate and pleasant to use for anybody. In an embodiment of the invention, the number of the coin cases is at least the same as that of the rotatable drums, the number of the coin shutters being the same as that of the rotatable drums, each of said shutters corresponding to one or more coin cases, said rotatable drums being adapted so that a rotatable drum having a low priority order does not hit unless all rotatable drums having a higher priority order (rotatable drums on one side) hit. According to this embodiment, the game becomes much more diversified and interesting.

As many apparently widely different embodiments of the invention may be made without departing from the spirit and scope thereof, it is to be understood that the invention is not limited to the specific embodiments thereof except as defined in the appended claims.

What is claimed is:

1. A slot machine comprising:

a frame, a plurality of drums rotatably mounted on a drum shaft horizontally disposed within said frame, each of said drums being provided on its periphery with pictures, symbols, etc., each of said drums being provided on its one side with a notched disc having shallow notches and deep notches, a supporting shaft disposed at a suitable distance from said drum shaft, a kicker rotatably mounted on said supporting shaft, said kicker having projections for kicking said notched discs, said kicker being usually given a tendency to turn in the direction of disengaging from said notched discs, movable frames corresponding to said drums, said movable frames being rotatably mounted on said supporting shaft, said movable frames being provided at one end with stoppers respectively engageable with said notched discs and at the other end with engaging portions, said movable frames being respectively given a tendency to turn in the direction of engaging said stoppers with said notched discs, said movable frames having connecting means between them, said movable frames being provided at their lower end with driving means, a cam plate rotatably disposed within said frame, said cam plate being adapted to engage with and disengage from said engaging portions of said movable frames by the turning of said cam plate, one edge of said cam plate being stepped so as to permit the engagements between said cam plate and said engaging portions to be released in regular sequence and at intervals according to the angle of said cam plate, said cam plate being usually controlled so as to be out of engagement with said engaging portions, an actuating lever attached to one end of said supporting shaft, said actuating lever turning said kicker against said tendency thereof so as to engage its projections with said notched discs, said actuating lever turning said movable frames against said tendency thereof and through said connecting means, said actuating lever further turning said cam plate against said control so that said cam plate engages with said engaging portions of said movable frames when said movable frames have been turned to a certain degree, a plurality of coin cases, the outlets of which are usually closed by means of coin shutters, coin stoppers corresponding to said coin shutters, said coin stoppers being driven by the driving means of said movable frames so as to open said coin shutters, a mechanical timer disposed on the side opposite to said actuating lever, said mechanical timer being adapted to turn said cam plate, engaged with said engaging portions of said movable frames, at a certain speed in the direction of disengagement therefrom, said drums, rotated by said projections of said kicker, being stopped by said stoppers of said movable frames in regular sequence and at invervals as said cam plate is rotated by means of said timer permitting stepwise disengagement of said engaging portions of said movable frames, said stopper or stoppers entering said deep notch or notches and one or some or all of said coin cases being opened when one or more predetermined pictures, symbols, etc. or a predetermined combination thereof is obtained.

2. A slot machine as claimed in claim 1, wherein the number of said coin cases is at least the same as that of said drums, and the number of said coin shutters is the same as that of said drums, each of said coin shutters corresponding to one or more coin cases.

3. A slot machine as claimed in claim 1, wherein unless a drum disposed at one end shows a predetermined picture, symbol, etc. when it is stopped, the stoppers of movable frames corresponding to the other drums are prevented from entering the deep notches of said other drums by said connecting means.

* * * * *